US009494301B2

(12) United States Patent
Muchandi et al.

(10) Patent No.: US 9,494,301 B2
(45) Date of Patent: Nov. 15, 2016

(54) LIGHTING HOUSING HAVING SELF-ADJUSTING HINGE MECHANISM

(71) Applicant: Appleton Grp LLC, Rosemont, IL (US)

(72) Inventors: Sagar Rudrappa Muchandi, Pune (IN); Vinaya Nandish Kubsad, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 111 days.

(21) Appl. No.: 14/566,936

(22) Filed: Dec. 11, 2014

(65) Prior Publication Data

US 2016/0003455 A1 Jan. 7, 2016

Related U.S. Application Data

(63) Continuation of application No. 29/495,760, filed on Jul. 3, 2014.

(30) Foreign Application Priority Data

Jul. 7, 2014 (IN) ..... 2205/MUM/2014

(51) Int. Cl.

| | |
|---|---|
| ***F21V 17/10*** | (2006.01) |
| ***F21S 8/04*** | (2006.01) |
| ***F21V 17/12*** | (2006.01) |
| ***F21V 7/00*** | (2006.01) |
| ***F21V 31/00*** | (2006.01) |
| ***F21V 15/01*** | (2006.01) |
| *F21Y 101/00* | (2016.01) |

(52) U.S. Cl.

CPC ..... *F21V 17/107* (2013.01); *F21S 8/043* (2013.01); *F21V 7/0066* (2013.01); *F21V 15/01* (2013.01); *F21V 17/12* (2013.01); *F21V 31/005* (2013.01); *F21Y 2101/00* (2013.01)

(58) Field of Classification Search

CPC .. F21V 17/0066; F21V 17/107; F21V 17/12; F21V 15/01; F21V 21/025; F21V 21/03; F21V 31/00; F21V 31/005; F21S 8/03; F21S 8/036; F21S 8/04; F21S 8/043; F21K 9/10; F21K 9/17

See application file for complete search history.

(56) References Cited

U.S. PATENT DOCUMENTS 3,118,621 A * 1/1964 Bailey ..... F21S 8/04 248/222.12
3,328,578 A * 6/1967 Gough ..... F21V 31/005 362/217.08

(Continued)

FOREIGN PATENT DOCUMENTS

DE 202012001869 5/2012

OTHER PUBLICATIONS

Dialight, SafeSite LED Linear Fixture—UL 844 for Indoor and Outdoor Hazardous Locations, pre-Jul. 2014 representative catalogue, 8 pages.

*Primary Examiner* — Alan Cariaso
(74) *Attorney, Agent, or Firm* — McDonnell Boehnen Hulbert & Berghoff LLP.

(57) ABSTRACT

A lighting fixture including alighting housing having a reflector member having that is attached to the bottom of the lighting housing, lights positioned beneath the reflector, first and second brackets positioned on the top surface the reflector member, wherein the reflector member is hingedly mounted to the lighting housing using a first fastener extending through the first bracket, and using a second fastener extending through the second bracket of the reflector member.

25 Claims, 11 Drawing Sheets

(56) References Cited

U.S. PATENT DOCUMENTS

| | | | | |
|---|---|---|---|---|
| 4,928,209 | A * | 5/1990 | Rodin | F21V 7/005 362/217.06 |
| 5,025,356 | A * | 6/1991 | Gawad | A01G 7/045 362/221 |
| 5,440,466 | A * | 8/1995 | Belisle | F21V 17/18 362/221 |
| 6,616,309 | B2 * | 9/2003 | Kelmelis | F21V 21/04 362/249.07 |
| 6,755,559 | B2 * | 6/2004 | Wang | F21S 8/04 362/147 |
| 6,945,671 | B1 * | 9/2005 | Swarens | F21V 14/02 362/220 |
| 7,997,761 | B2 | 8/2011 | Peck et al. | |
| 8,066,400 | B2 | 11/2011 | Curran et al. | |
| 8,226,271 | B2 * | 7/2012 | Mo | F21K 9/00 362/243 |
| 8,231,245 | B2 | 7/2012 | Weimer et al. | |
| 8,272,763 | B1 * | 9/2012 | Chinnam | F21V 29/004 362/147 |
| 8,602,599 | B2 | 12/2013 | Zimmer et al. | |
| 8,764,243 | B2 | 7/2014 | Zimmer et al. | |
| 2004/0200035 | A1 | 10/2004 | Fries | |
| 2014/0292198 | A1 * | 10/2014 | Sanders | F21V 15/01 315/86 |
| 2015/0267873 | A1 * | 9/2015 | Price | F21K 9/17 362/235 |
| 2015/0267910 | A1 * | 9/2015 | Lazalier | F21K 9/50 362/267 |

* cited by examiner

LIGHTING HOUSING HAVING SELF-ADJUSTING HINGE MECHANISM

RELATED APPLICATIONS

The present application claims priority to U.S. patent application Ser. No. 29/495,760 entitled "Linear LED Lighting Housing" filed Jul. 3, 2014, and also claims priority to Indian Patent Application No. 2205/MUM/2014 entitled "Linear LED Lighting Housing" filed on Jul. 7, 2014, the contents of both of which are incorporated by reference herein in their entirety.

BACKGROUND

The present application generally relates to a lighting fixture. More particularly, the present application relates to a housing for an overhead lighting fixture having a hinge mechanism used to pivotally attach the housing to a reflector member positioned beneath the housing.

Overhead lighting is used in a wide variety of applications. For example, overhead lighting may be used for lighting commercial and industrial buildings, such as offices, warehouses, and manufacturing facilities. Overhead lighting may also be used in hazardous locations, where a high degree of corrosion resistance and protection against dirt, water and moisture is necessary. In such environments it may be desirable to seal the electrical components within the lighting fixture. Seals or gasket material of varying thicknesses may be used to provide the sealing, depending on the application and environment. However, unsealing the lighting fixture for purposes of maintaining or replacing electrical components while the lighting fixture is mounted overhead presented a number of challenges to technicians, including the removal of screws and reflector cover while perched upon a ladder or platform.

Furthermore, in the past, overhead lighting fixtures having tubular fluorescent bulbs were widely used. In particular, lighting fixtures having T8 or T12 tubular fluorescent bulbs were widely used. However, replacing the T8 or T12 bulb or the associated ballast presented certain challenges, such as safely removing the bulb without breaking or dropping it, and accessing and removing the ballast.

In recent years, LED lighting has become more and more popular. LED lighting may be advantageous because LED lighting typically has a longer life than fluorescent lighting and they are very energy efficient.

However, because the components used for LED lighting generate a lot heat, it is desirable to provide suitable heat dissipation features and designs for the LED light fixture and housing. In addition, overhead lighting in general provides a number of challenges in terms of servicing, maintaining, and replacing the lights or LED arrays and other internal components associated with the lighting fixture. Therefore, it would be desirable to provide a lighting fixture that provides for improved ease of servicing, maintaining, and replacing the lights and other internal components of the lighting fixture. In addition, there is a large installed base of overhead lighting fixtures that may include T8 or T12 fluorescent bulbs, and it would be desirable to provide an LED lighting fixture with a housing that may be used to retrofit and replace existing overhead lighting fixtures that use T8 or T12 fluorescent bulbs.

SUMMARY

In one aspect, a lighting fixture is provided including alighting housing having a top side, a bottom side, a front side, a rear side, a first end and a second end, a reflector member having a top surface, said reflector member attached to the bottom of the lighting housing with a plurality of fasteners extending through the reflector member, lights positioned beneath the reflector, a first bracket positioned on the top surface of the reflector member, a second bracket positioned on the top surface of the reflector member, wherein the reflector member is hingedly mounted to the housing using a first fastener extending through a vertical slot of the first bracket on the reflector member, and using a second fastener extending through a vertical slot of the second bracket of the reflector member.

In a further aspect, an lighting fixture is provided including an housing having a top side, a bottom side, a front side, a rear side, a first end and a second end, a reflector member having a top surface, said reflector member attached to the bottom of the housing with a plurality of fasteners extending through the reflector member, LED lights positioned beneath the reflector, a first lighting fixture mounting bracket attached to the top side of the housing, and a second lighting fixture mounting bracket attached to the top side of the LED housing.

In a further aspect, a lighting fixture is provided including a lighting housing having a top side, a bottom side, a front side, a rear side, a first end and a second end, a reflector member having a top surface, said reflector member attached to the bottom of the lighting housing with a plurality of fasteners extending through the reflector member, lights positioned beneath the reflector, a hinge having a first flange secured to the rear side of the lighting housing and a second flange secured to the top surface of the reflector member, wherein one of the first and second flanges is secured by using one or more mounting screws extending through one or more vertical slots in the one of the first and second flanges.

In yet a further aspect, the lighting fixtures may further include a seal positioned between the lighting housing and the reflector member, wherein the vertical slots are adapted to adjust to seals of varying thicknesses.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

In FIGS. 1-22, an example embodiment of a self-adjusting hinge mechanism is disclosed that is used to attach a reflector/cover sub-assembly of a lighting fixture to a housing/body sub-assembly of the lighting fixture. The self-adjusting hinge mechanism advantageously allows for the reflector/cover sub-assembly to pivot downwardly from the housing/body sub-assembly while remaining attached thereto. The self-adjusting hinge mechanism also advantageously allows for gaskets or seals of varying thickness to be used as a seal between the reflector/cover sub-assembly and the housing/body sub-assembly. Seals of varying thickness may be used depending on the application and environment in which a lighting fixture is being used. Accordingly, the self-adjusting hinge mechanism allows a lighting fixture to be used with gaskets or seals of varying thickness and used in a variety of environments.

In the example embodiment shown in FIGS. 1-22, the self-adjusting hinge mechanism is illustrated in connection with a lighting housing 100 that is an LED lighting housing and reflector member 200. However, the self-adjusting hinge mechanism may be used with any number of different types of housings, such as a cast housing, and is not limited to an LED housing or a housing having the configuration and geometry shown in FIGS. 1-22. Similarly, the reflector member 200 may including a variety of lighting, including tubular fluorescent lighting, incandescent lighting, as well as LED lighting, and is not limited to use with LED lighting or a reflector member having the configuration and geometry shown in FIGS. 1-22.

Figure 1:
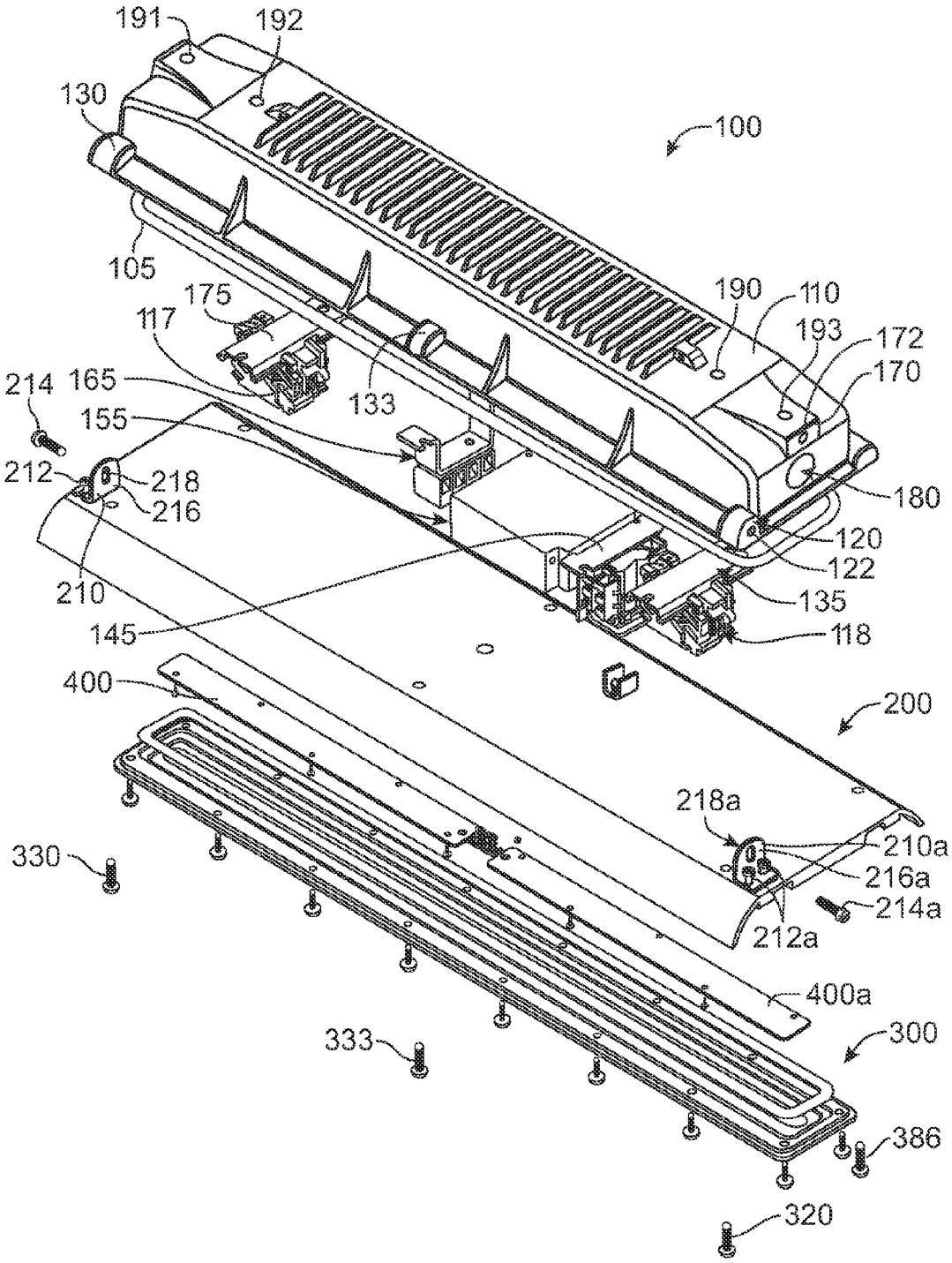
FIG. 1 is an exploded perspective rear side view of a lighting fixture 10 having lighting housing 100 and reflector member 200, according to an example embodiment.
Figure 2:
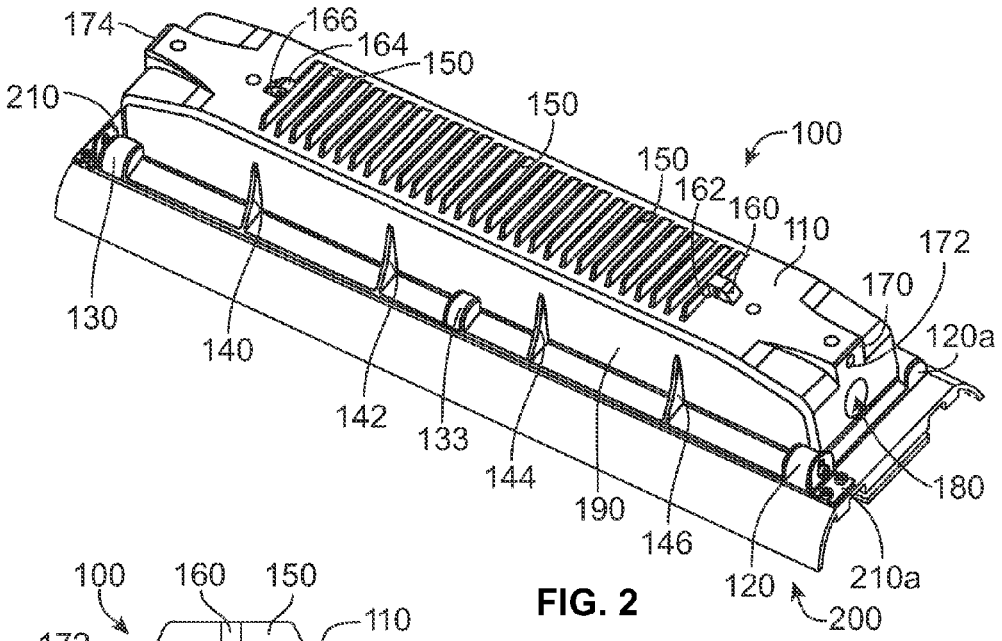
FIG. 2 is a perspective rear side view of the lighting fixture 10 shown in FIG. 1, according to an example embodiment.

FIG. 1 illustrates an exploded perspective view of lighting housing 100 and reflector member 200 of lighting fixture 10. Lighting housing 100 includes bosses 130, 133, and 120 on a rear side of thereof, that include threaded holes on an underside thereof that are adapted to receive screws 330, 333, and 320 that are used to secure the reflector member 200 to the lighting housing 100. The front side of the lighting housing 100 includes similar bosses adapted for attachment to screws, including screw 386 and two other screws not shown, to further secure the reflector member 200 to the lighting housing 100.

Lens assembly 300 and LED/PCB arrays 400 and 400*a* are positioned in an underside of the reflector member 200. Lighting housing 100 is used to house din rail 135 and terminal block 118, terminal block assembly 165, driver 155, contact block assembly 145, and din rail 175 with terminal block 117. Lighting housing 100 includes mounting holes 190 and 193, and mounting holes 191 and 192, on a top side 110 of lighting housing 100 that may be used to mount various brackets or chains to the lighting housing that may be used for mounting purposes. Of course, other lighting sources in addition to LED lighting may also be used.

A first mounting bracket 210 is mounted to a top surface of an end of reflector member 200. First mounting bracket 210 is secured to reflector member 200 with a pair of screws 212, and includes an upwardly extending flange 216 that includes a vertical slot or cutout 218 adapted to receive screw 214. Screw 214 extends through vertical slot or cutout 218 and into a threaded hole tapped in boss 130 of lighting housing 100. Similarly, a second mounting bracket 210*a* is mounted to a top surface of the other end of reflector member 200. Second mounting bracket 210*a* is secured to reflector member 200 with a pair of screws 212*a*, and includes an upwardly extending flange 216*a* that includes a vertical slot or cutout 218*a* adapted to receive screw 214*a*. Screw 214*a* extends through vertical slot or cutout 218*a* and into a threaded hole 122 tapped in boss 120 of lighting housing 100.

Figure 13:
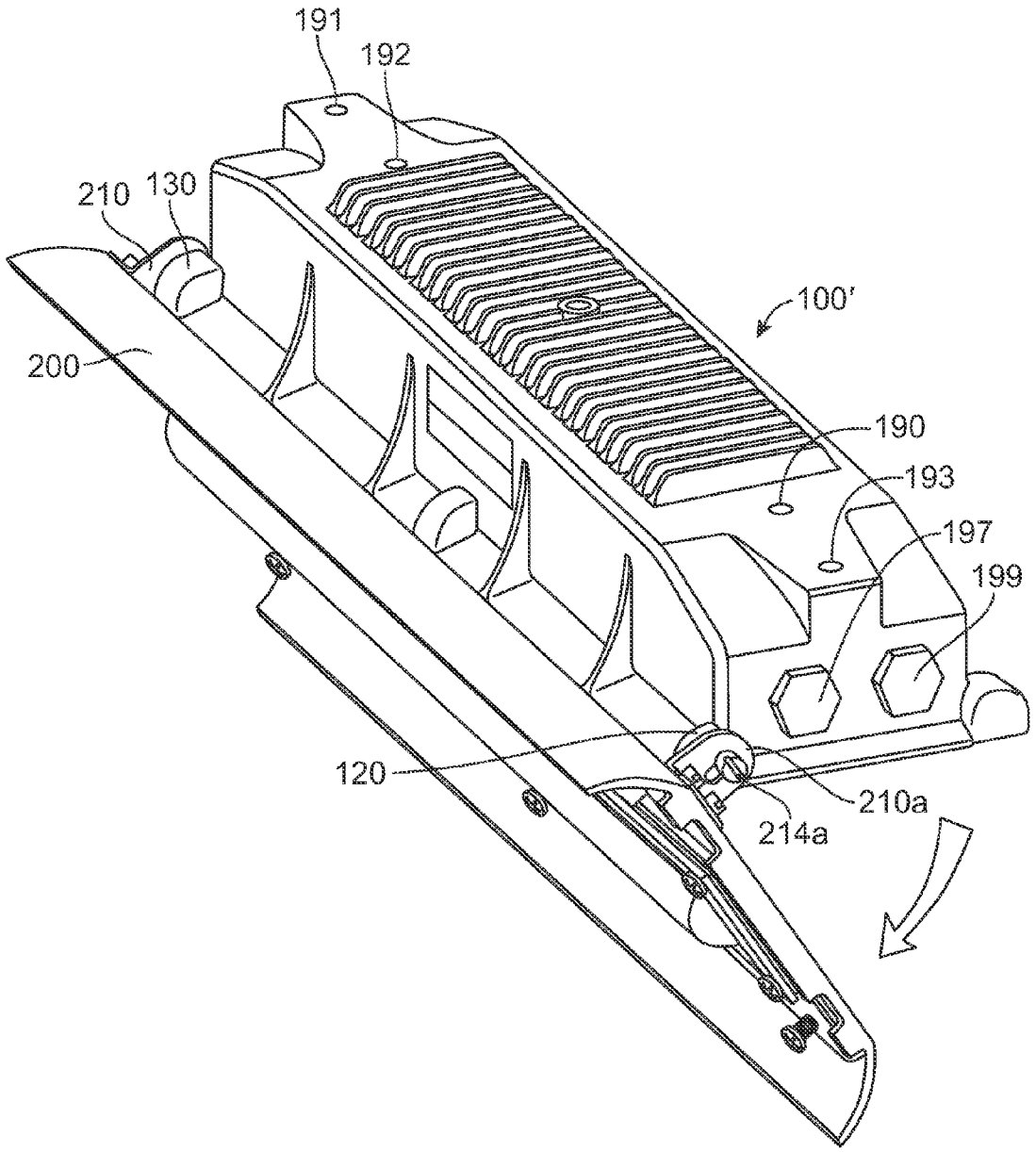
FIG. 13 is a perspective view of LED lighting housing 100' showing reflector member 200 pivoted downwardly to provide access to the components within the LED lighting housing 100'.

When screws, including screws 330, 333, 320, and 386 are unscrewed, as illustrated in FIG. 13, reflector member 200 may pivot downwardly about bosses 130 and 120 to provide ready access for a technician to perform service, maintenance, or replacement of the various components within the lighting housing 100. The screws, including 330, 333, 320, and 386 are preferably captive screws that remain positioned within reflector member 200 even when unscrewed from the lighting housing so that they are retained in place, thereby preventing the screws from separating from the reflector member 200, so that they do not fall or become lost during maintenance or repair of the lighting fixture.

The hinged mounting of the reflector member 200 advantageously allows a technician to access the inner components of the lighting housing from below, where the components may be more easily identified, viewed, and replaced. Referring back to FIG. 1, once the service or maintenance is complete, the reflector member 200 may be simply swung back up into position against the bottom of lighting housing 100 where retained screws 330, 333, 320, and 386 may be screwed back into the lighting housing 100 to again secure the reflector member 200 beneath the lighting housing 100. In this manner, unlike typical prior designs, maintenance and service may be performed from beneath the lighting housing, without removing the lighting device from its mounted location.

The lighting housing may be a die-cast housing, made of a heat conductive material such as aluminum. As shown in FIGS. 2-7, lighting housing 100 includes a plurality of fins 150 positioned transversely on the top side 110 of lighting housing. Fins 150 serve to dissipate heat generated by the LED arrays, drivers, and other electronic components. Fins 150 could also have a different orientation on the top side 110 of lighting housing 100, such as extending in a longitudinal direction. Ribs 140 and 142 are positioned between bosses 130 and 133, and ribs 144 and 146 are positioned between bosses 133 and 120. The ribs provide additional structural support to lighting housing 100.

Figure 3:
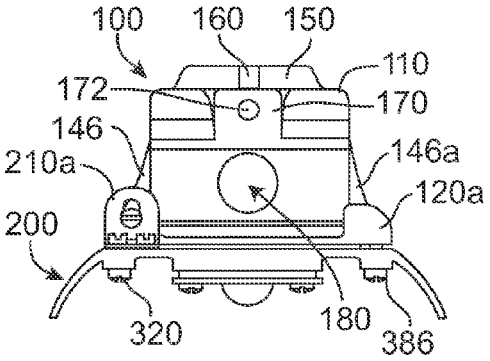
FIG. 3 is a left side view of lighting fixture 10 shown in FIGS. 1 and 2.
Figure 4:
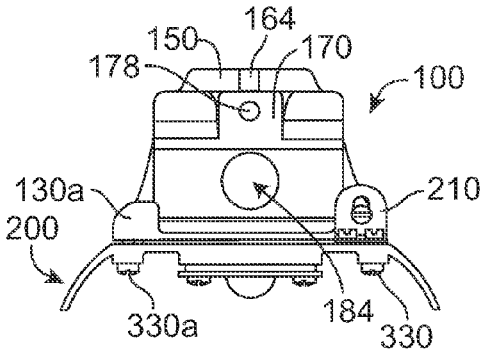
FIG. 4 is a right side view of lighting fixture 10 shown in FIGS. 1-3.

In addition, and further shown in FIGS. 3 and 4, brackets 210 and 210*a* are shown hingedly attaching lighting housing 100 to reflector member 200. Holes 180 and 184 are shown on the ends of the lighting housing 100 to allow the positioning of a connector and/or the passage of electrical wires. In other embodiments, such as shown in FIG. 13, a pair of holes may be positioned on the ends of the light housing for the passage of electrical wires. Furthermore, raised protrusions 170 and 174 are provided that may include mounting holes, such as holes 172 and 178. Furthermore, bosses 160 and 164 may be positioned on the top side 110 of lighting housing 100. Bosses 160 and 164 may include holes 162 and 164 respectively that may also be used for mounting purposes. Mounting screws 320 and 386, and mounting screws 330 and 330*a* are shown securing reflector member 200 to the lighting housing 100.

Figure 5:
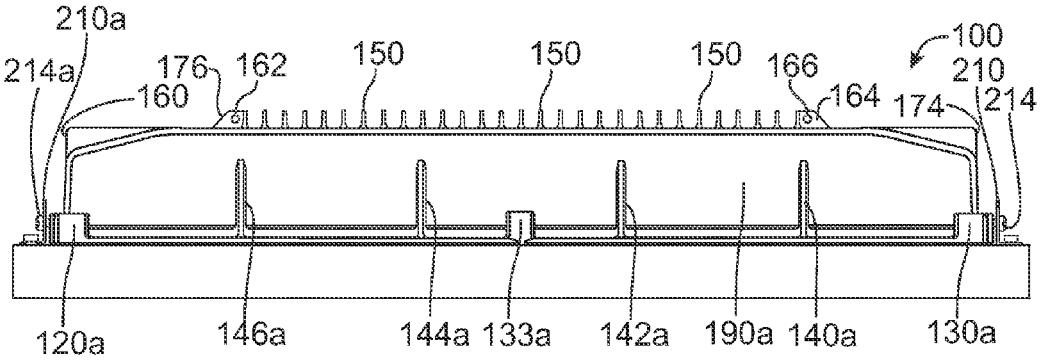
FIG. 5 is a front side view of lighting fixture 10 shown in FIGS. 1-4.
Figure 6:
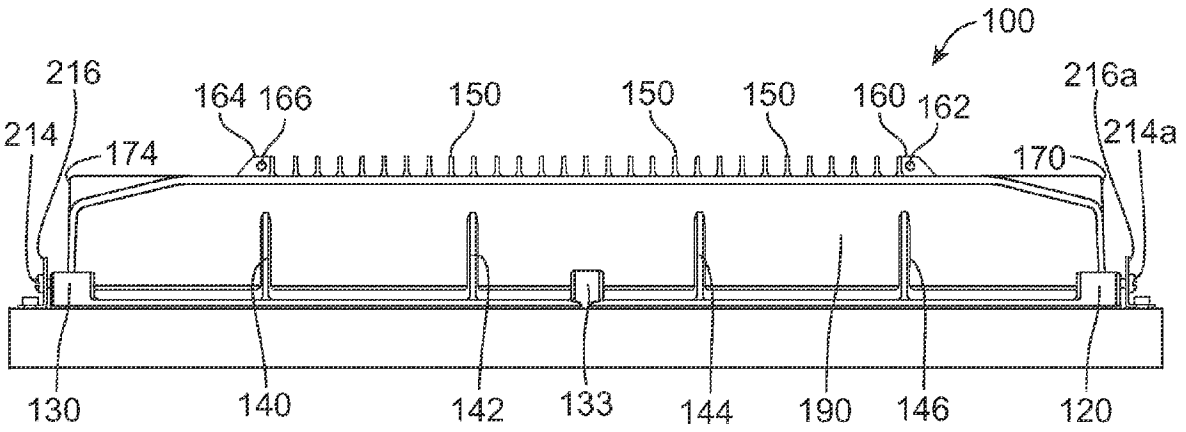
FIG. 6 is a rear side view of lighting fixture 10 shown in FIGS. 1-5.
Figure 7:
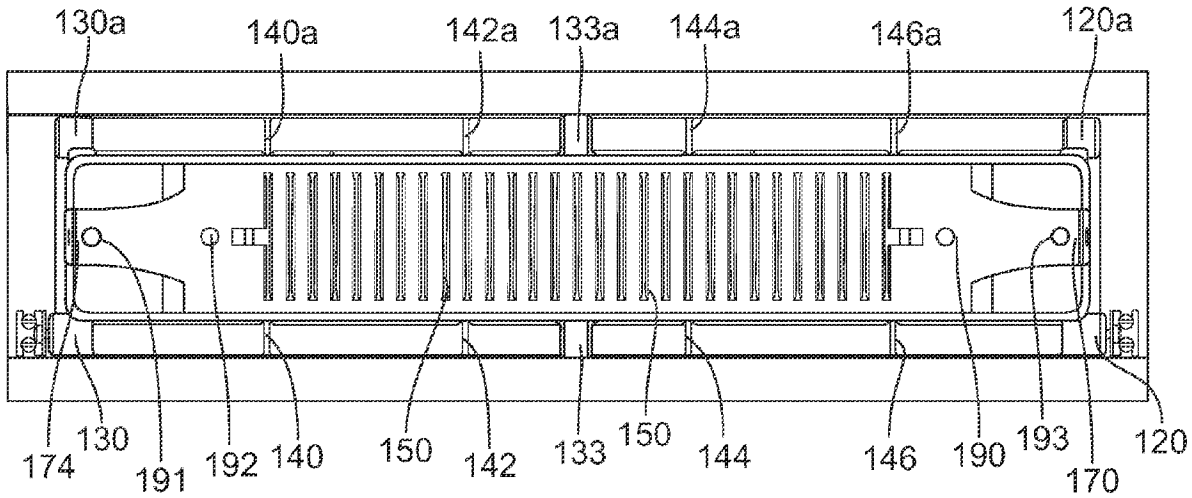
FIG. 7 is a top view of lighting fixture 10 shown in FIGS. 1-6.

As shown in FIGS. 5 and 7, ribs 140*a* and 142*a* are positioned between bosses 130*a* and 133*a*, and ribs 144*a* and 146*a* are positioned between bosses 133*a* and 120*a*. The ribs provide additional structural support to lighting housing 100.

Figure 8:
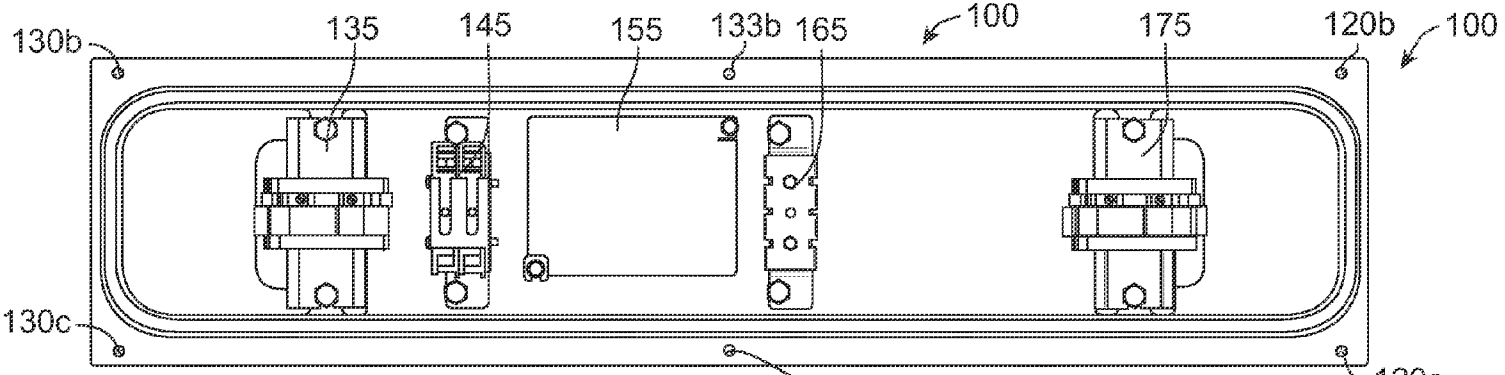
FIG. 8 is a bottom view of lighting fixture 10 shown in FIGS. 1-7.
Figure 9:
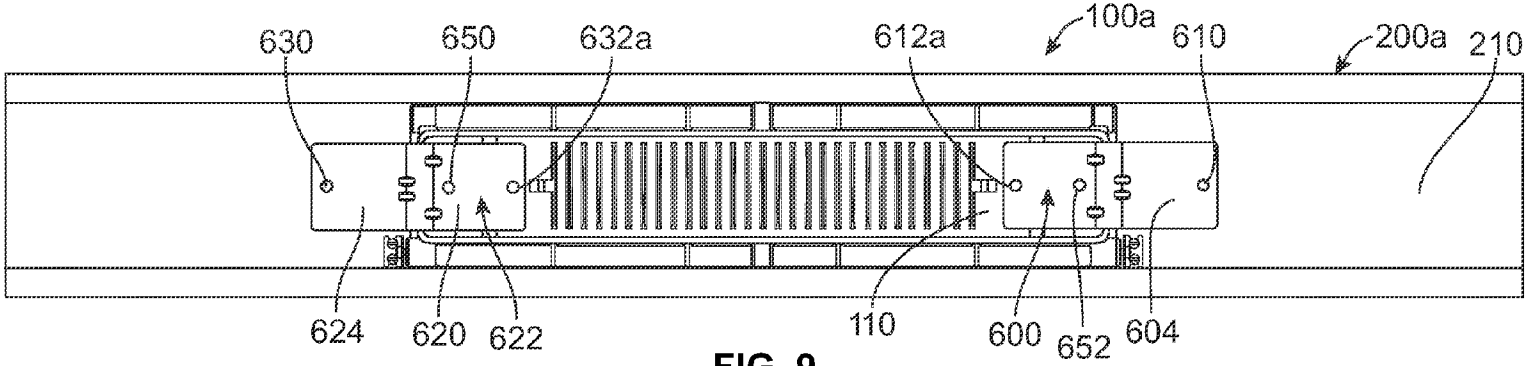
FIG. 9 is a top view of lighting fixture 10*a* having lighting housing 100*a* and reflector member 200*a*, according to an example embodiment.

FIG. 8 is a bottom view of the light housing 100. The lighting housing includes tapped holes 130*b*, 133*b*, 120*b*, and 130*c*, 133*c*, and 120*c* for receiving mounting screws, including mounting screws 330, 333, 320, and 386 shown in FIG. 1 that are used to secure the reflector member 200 to the lighting housing 100. Din rails 135 and 175 are shown holding terminal blocks in place within the lighting housing, and driver 155, contact block assembly 145, and terminal block assembly 165 are also shown positioned within lighting housing 100.

FIG. 7 is a top view of the lighting housing 100. Mounting holes 190 and 192 are positioned on the top surface 110 of lighting housing 100. As noted above, mounting holes 190 and 193, and mounting holes 191 and 192, may be used to attach lighting housing 100 to a variety of mounting brackets and elements. However, mounting holes 190 and 192 are also specifically adapted for attaching lighting fixture mounting brackets 600 and 620 (shown in FIGS. 9-11) described in more detail below.

Lighting fixture 10 may be used to retrofit existing tubular fluorescent lighting fixtures having a length of two feet, by using mounting holes 190 and 192 positioned on the top surface 110 of lighting housing 100 in both the 2.5K and 5K lumen lighting device. Mounting holes 190 and 192 may be positioned 400 mm apart to allow for the retrofitting of lighting housing 100 into existing mounting structures used with tubular fluorescent lighting devices, which commonly have mounting holes spaced 400 mm apart. Thus, lighting fixture 10 having mounting holes 190 and 192 positioned on a top side 110 of lighting housing 100 spaced apart 400 mm provides a ready solution to retrofit and change existing tubular fluorescent lighting devices having a length of 2 feet over to an LED design, or other type of non-tubular fluorescent lighting design. Of course, it is also possible to use the lighting fixture 10 with tubular fluorescent bulbs as well.

FIGS. 9-12 illustrate lighting fixture 10 having lighting housing 100*a* which may be used for a 7.5K lumen lighting device, wherein four linear LED arrays, such as array 400 shown in FIG. 1 may be aligned in a linear fashion within the reflector 200*a*. Other types of lighting in addition to LED lighting may also be used. Lighting housing 100*a* may be the same size as lighting housing 100, and include the same tapped holes 130*b*, 133*b*, 120*b*, and 130*c*, 133*c*, and 120*c* for receiving mounting screws, including mounting screws 330, 333, 320, and 386 shown in FIG. 1 that are used to secure the reflector member 200*a* to the lighting housing 100*a*. As with lighting housing 100, lighting housing 100*a* includes din rails 135 and 175 shown holding terminal blocks in place within the lighting housing, as well as driver 155, contact block assembly 145, and terminal block assembly 165. In addition, lighting housing 100*a* also includes a second driver 155*a* for powering the additional LED arrays for the 7.5K lumen design.

Lighting fixture 10*a* may be used to retrofit existing tubular fluorescent lighting fixtures having a length of four feet, by using first and second lighting fixture mounting brackets 600 and 620. The first lighting fixture mounting bracket 600 includes a first flange 602 attached to the first end of the housing 100*a* using mounting hole 612*a* and 652. An extending member 606 has a first end attached to the first flange 602 and upwardly extends from the top side of the lighting housing 100*a* where a second end of the extending member 606 is attached to a second flange 604 that outwardly extends past the first end of the lighting housing 100*a*. Second flange 604 includes a mounting hole 610. First flange 602 includes mounting holes 612*a* and 652 adapted to align with mounting holes 190 and 193 on lighting housing 100.

Similarly, second lighting fixture mounting bracket 620 includes a first flange 622 attached to the second end of the lighting housing 100*a*, and extending member 626 having a first end attached to the first flange 622, and upwardly extends from the top side of the lighting housing 100*a*, where a second end is attached to a second flange 624 that outwardly extends past the second end of the lighting housing 100*a*. Second flange 624 includes a mounting hole 630.

In this embodiment, the first flange 602 and the second flange 604 of the first lighting fixture mounting bracket 600 are positioned in parallel planes, and the first flange 622 and the second flange 624 of the second lighting fixture mounting bracket 620 are positioned in parallel planes. In this manner, the upper surfaces of second flange 604 and second flange 624 may provide a flush mounting surface. In fact, the upper surfaces of second flange 604 and second flange 624 may be coplanar to provide for an even, horizontal mounting of the lighting housing 100*a*.

In addition, because an existing mounting pattern for tubular fluorescent lighting fixtures having a length of four feet has a distance between mounting holes greater than the length of the lighting housing 100*a*, the second flanges 604 and 624 advantageously extend beyond the respective first and second ends of the lighting housing 100*a*. Mounting holes 610 and 630 in the second flanges 604 and 624 may be positioned 700 mm (or 27.6 inches) apart to allow for the retrofitting of lighting fixture 10*a* into existing mounting structures used with tubular fluorescent lighting devices having a length of four feet. Thus, lighting fixture 10*a* having lighting fixture mounting brackets 600 and 620 attached to lighting housing 100*a* provides a ready solution to retrofit and change existing tubular fluorescent lighting devices over to an LED design, or other type of non-tubular fluorescent lighting design. Of course, it is also possible to use the lighting fixture 10*a* with tubular fluorescent bulbs as well.

In this regard, as shown in FIGS. 1-7, the top side 110 of the lighting housing 100 includes raised protrusion 170 and 174 that extend outwardly from the top side 110 of the lighting housing 100. Raised protrusions 170 and 174 advantageously provide a greater bearing surface for the interface between the top side 110 of lighting housing 100 and first flange 602 of the first lighting fixture mounting bracket 600 and the first flange 622 of the second lighting fixture mounting bracket 622.

Figure 11:
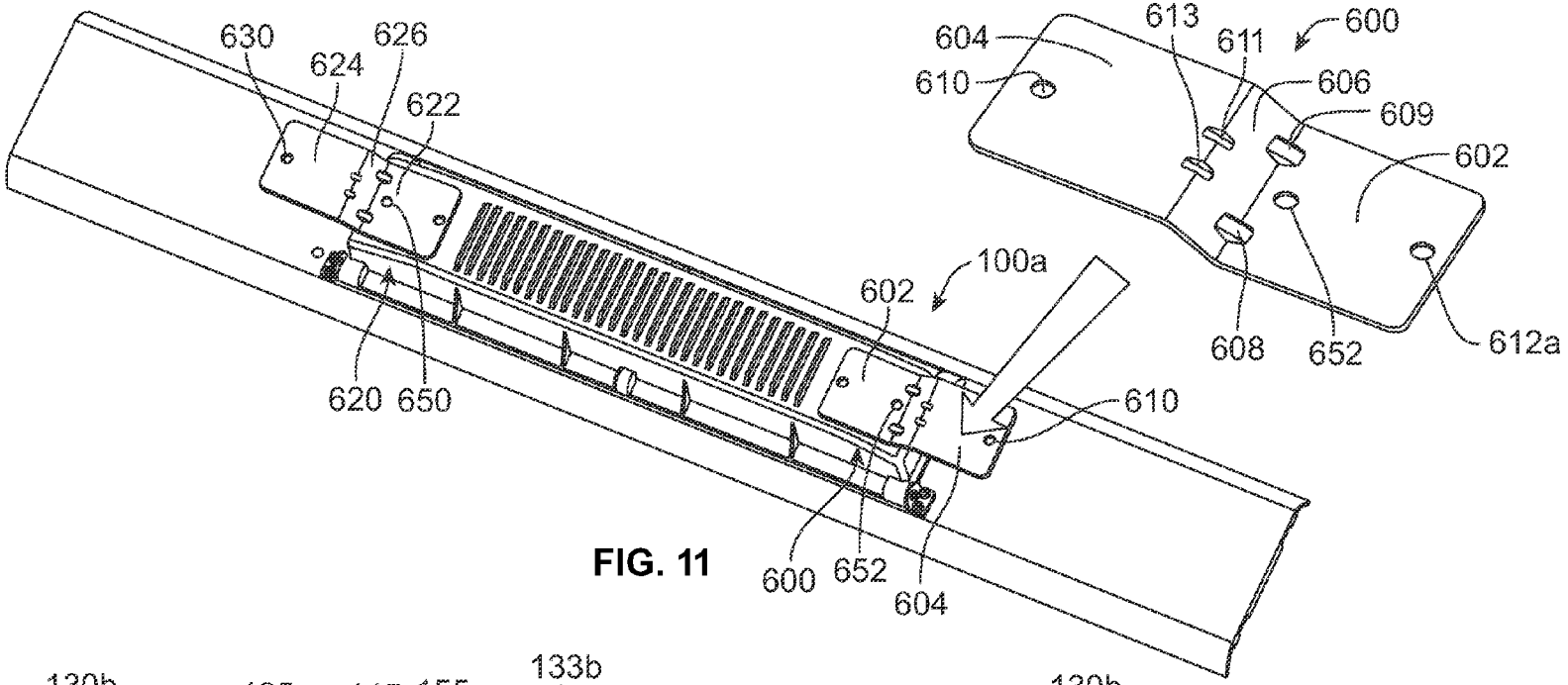
FIG. 11 is a perspective rear view of lighting fixture 10*a* shown in FIGS. 9 and 10.
Figure 12:
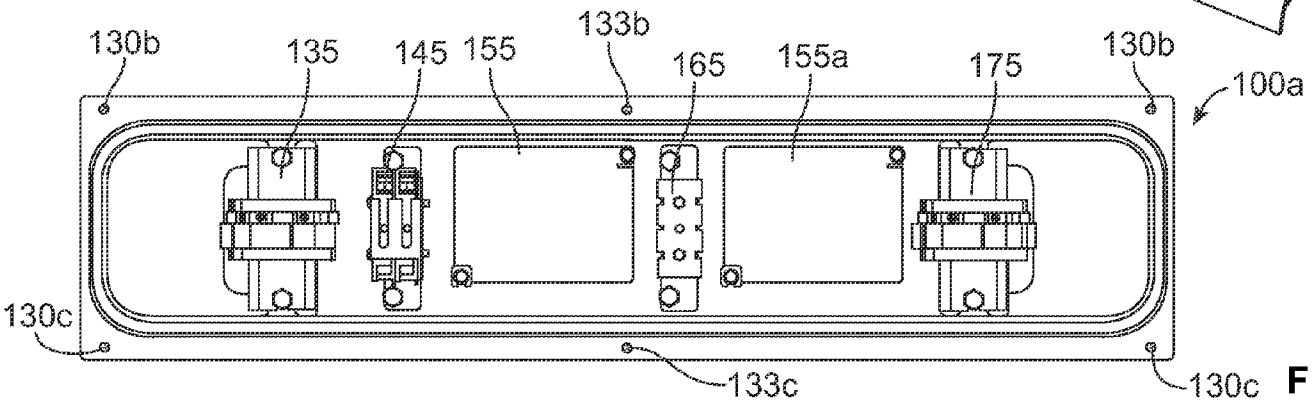
FIG. 12 is a bottom view of lighting fixture 10*a* shown in FIGS. 9-11.

In addition, to impart greater strength into the lighting fixture mounting flanges 600 and 620, a pair of notches may be positioned in a transition from the first flange to the extending member and a pair of notches may be positioned in a transition from the extending member to the second flange. In particular, as shown in FIG. 11, the lighting fixture mounting bracket 600 includes notches 606 and 609 in the transition from the first flange 602 to the extending member 606, and also includes notches 611 and 613 in the transition from extending member 606 to second flange 604. Lighting fixture mounting bracket 604 may include the same notching arrangement.

Figure 10:
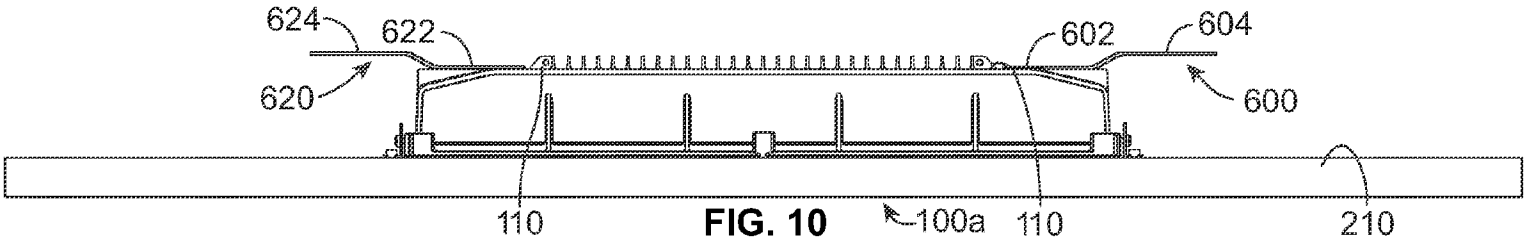
FIG. 10 is a front side view of the lighting fixture shown in FIG. 9.

In addition, as shown in FIG. 10, the top surfaces of the plurality of fins 150 on the top side 110 of the lighting housing 110*a* are positioned beneath a plane that the second flange 604 of the first lighting fixture mounting bracket 600 and the second flange 624 of the second lighting fixture mounting bracket 624 are positioned in. In this manner, the fins do not interfere with the mounting of the lighting housing 100*a*.

FIG. 13 illustrates lighting housing 100' having two connectors 197 and 199 positioned within holes in an end of the lighting housing 100', instead of one hole 180 as shown in FIG. 1. Some jurisdictions typically require two wiring holes, whereas others only require one. Lighting housing 100' includes mounting holes 190 and 193 one end, and mounting holes 191 and 192 on the other end. Reflector member 200 is shown downwardly pivoted from lighting housing 100' about the hinged attachment of bracket 210*a* with boss 120 with screw 214*a* and the hinged attachment of bracket 210 with boss 130. As noted above, the hinged mounting of reflector member 200 to the lighting housing 100' provides the ability for a technician to access the interior of lighting housing 100' from the bottom side thereof, where the components within the lighting housing may be more easily identified, viewed, and installed/replaced during servicing or installation.

The lighting housings described herein may advantageously be used in hazardous locations, and in locations where it is desirable to have a high degree of corrosion resistance and protection against dirt, water and moisture. As shown in FIG. 1, a gasket member 105 may be positioned between the top surface of reflector member 200 and the bottom surface of lighting housing 100. As mounting screws, including mounting screws 330, 333, 320, and 386 are tightened, the gasket member 105 becomes compressed, thereby helping to prevent dirt, moisture, and debris from entering the interior of lighting housing 100, and thereby protecting the electrical components positioned therein.

Figure 14:
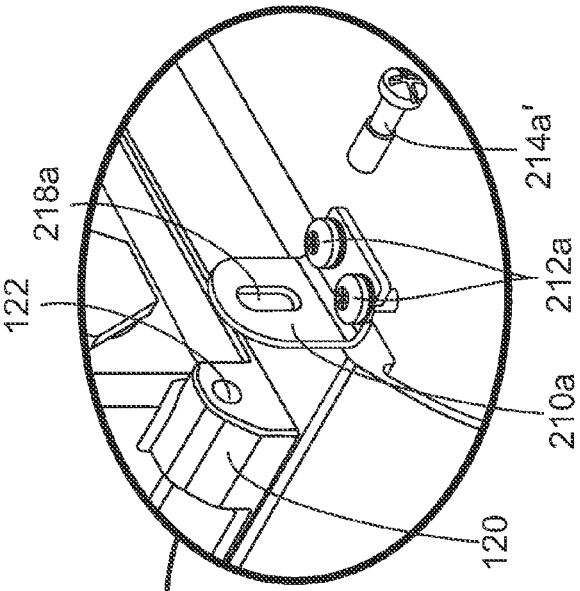
FIG. 14 is a perspective rear side view of LED lighting housing 100' shown in FIG. 13 having an exploded close-up view of the hinged mounting of the reflector member 200.
Figure 14:
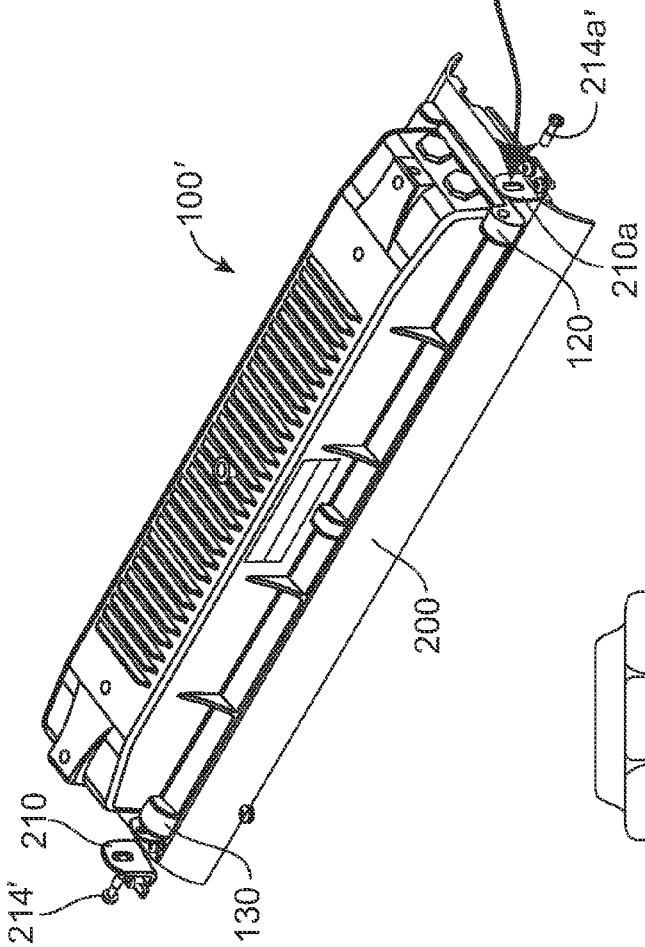
Figure 15:
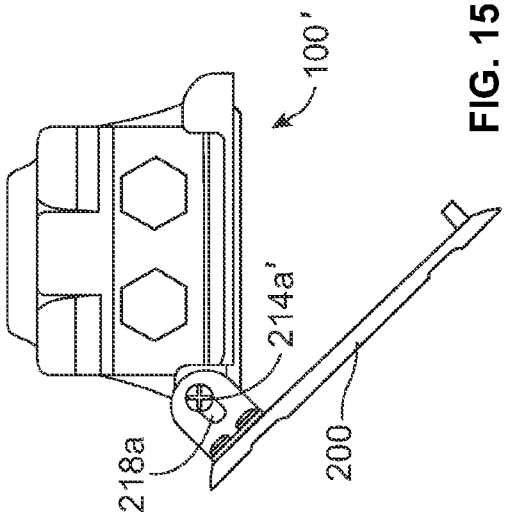
FIG. 15 is a left side view of the LED lighting housing 100' shown in FIGS. 13 and 14 showing reflector member 200 pivoted downwardly to provide access to the components within the LED lighting housing 100'.
Figure 16:
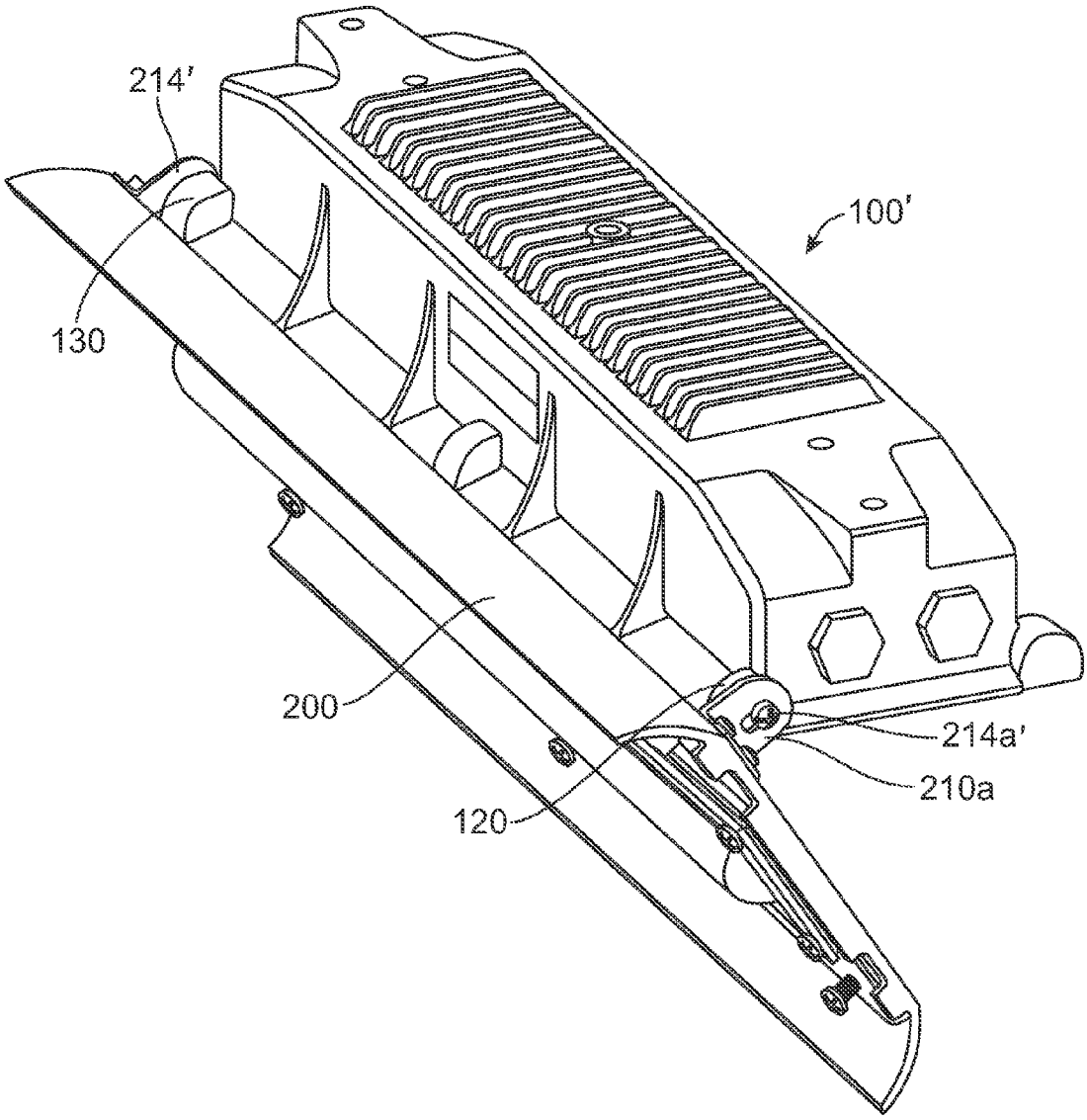
FIG. 16 is a perspective view of the LED lighting housing 100' shown in FIGS. 13-15 showing reflector member 200 pivoted downwardly to provide access to the components within the LED lighting housing 100'.
Figure 18:
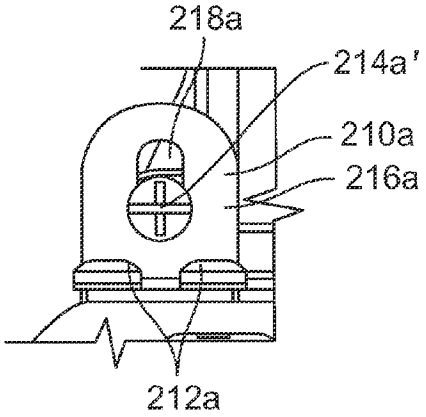
FIG. 18 is a close up side view of bracket 210 having elongated slot or cutout 218*a;*

As shown in FIGS. 14-16, the reflector member 200 is hingedly mounted on a rear side of the lighting housing and includes a closing/hanging hinge mechanism formed with bracket 210*a*, boss 120, and mounting screw 214*a'* on one end and bracket 210, boss 130, and mounting screw 214' on the other end. Depending on the location or environment, different types of material may be used for gasket member 105. As a result, gasket member 105 may have varying thicknesses. As illustrated in the exploded portion of FIG. 14, the bracket 210*a* may include a vertical slot or cutout 218*a* through which mounting screw 214*a'* extends to secure bracket 210*a* to boss 120 of lighting housing 100. A corresponding vertical slot or cutout is also positioned on bracket 210. Vertical slot or cutout 218*a* advantageously allows the hinge mechanism to accommodate gasket members of varying thicknesses or hardnesses. For thicker and/or harder gasket members 105, mounting screw 214*a'* will be positioned closer to the top of vertical slot or cutout 218*a* and for thinner and/or softer gasket members 105, the mounting screw 214*a'* will be positioned closer to the bottom of vertical slot or cutout 218*a*.

Thus, the hinge mechanism provides a user with the freedom to use different types of gaskets having a varying thickness and/or hardness. This freedom is achieved by using vertical slot or cutout 218*a* in bracket 210*a*. The lighting housing 100' is placed between the two symmetrically mounted brackets 210 and 210*a* on lighting housing 100'. As shown in detail in FIGS. 17, 18, and 20, bracket 210*a* is mounted to the top of reflector member 200 using a pair of mounting screws 212*a* extending through a lower bracket 221 of bracket 210*a*. Bracket 210 is similarly mounted on the other end of reflector member 200. Mounting screw 214*a* may be a bolt/rivet/screw which is fixed/screwed to lighting housing 100' into mounting hole 122 in boss 120 (or corresponding mounting hole in boss 130) passing through the vertical slot or cutout 218*a* provided in the bracket 210*a* (and corresponding vertical slot or cutout in bracket 210) and into the respective bosses 120 and 130 to complete the hinge mechanism.

Figure 20:
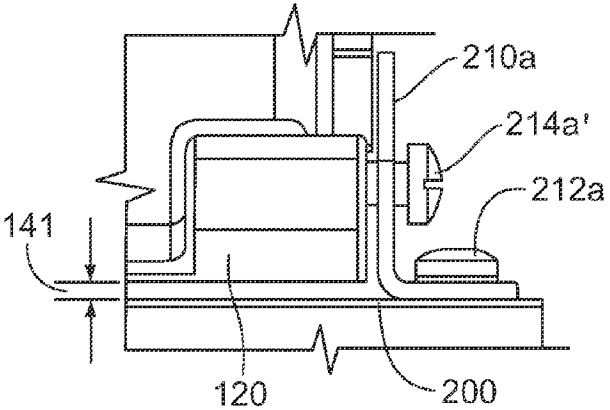
FIG. 20 is a closely side up rear view showing bracket 210 mounted to boss 120.

A calculated clearance or gap 217 may be provided between the outer facing edge of boss 120, bracket 210*a*, and head of mounting screw 214*a'* to provide a clearance for easy hinging action between the lighting housing 100' and reflector member 200 without interference from mounting screw 214*a*. The vertical slot or cutout 218*a* in upper flange 216*a* of mounting bracket 210*a* advantageously provides a feature that helps in self adjustment/alignment between the mating lighting housing 100' and reflector member 200. As shown in FIG. 20, a gap 141 may be provided between the bottom surface of lighting housing 100' and the top of reflector member 200 to accommodate for gasket member 105 (shown in FIG. 1).

The "hinge mechanism" is designed to provide an easy access to the internal components which are mounted inside the lighting housing 100' without requiring the complete fixture to be dismantled from the mounted locations. The hinged design can also accommodate any small misalignments between the lighting housing 100' and reflector member 200. It also provides an advantage of setting the compression value for different type of gaskets that may be used for gasket member 105.

Typical LED lighting fixtures in the market do not provide a hinge mechanism to allow easy access to the components of the fixture, as the LED housing and reflector are mating assemblies that are typically clamped or fixed with nuts and bolts. Such a design restricts the access to internal parts when the fixture is mounted to the ceiling or in a mounted condition.

As noted above, in the present embodiments the mounting brackets 210 and 210*a* are mounted to the top of reflector member 200 which is a mating part with the bottom of lighting housing 100'. A gasket member 105 (shown in FIG. 1) is placed in between the lighting housing 100' and the reflector member 200 to provide a desired/required degree of ingress protection. The hinge brackets 210 and 210*a* are provided with an intended vertical slots or cutouts 218 and 218*a*. The brackets 210 and 210*a* are symmetrically fixed on the reflector member 200 on opposite ends by using bolt/rivets/screw, such as pair of screws 212*a*. The assembled hinge brackets 210 and 210*a* positioned on the top of reflector member having vertical slots or cutouts 218 and 218*a* that are aligned with corresponding tapped holes on the outer ends of bosses 120 and 130 located at both the ends of the lighting housing 100. Mounting screws 214 and 214*a* are placed through the vertical slots or cutouts 218 and 218*a* respectively and are used to hingedly mount the reflector member 200 beneath lighting housing 100'.

Figure 17:
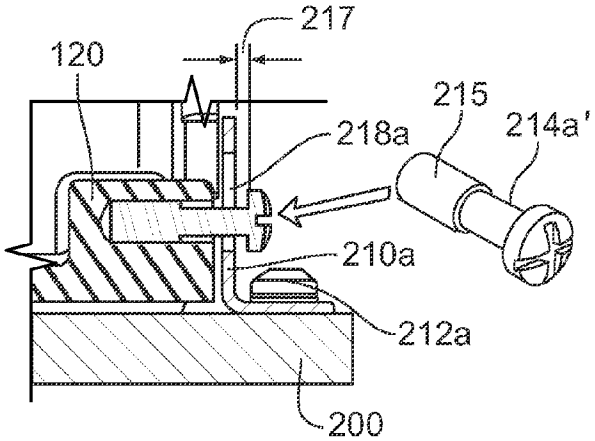
FIG. 17 is a cross sectional close up view of bracket 210*a* mounted to boss 120.
Figure 19:
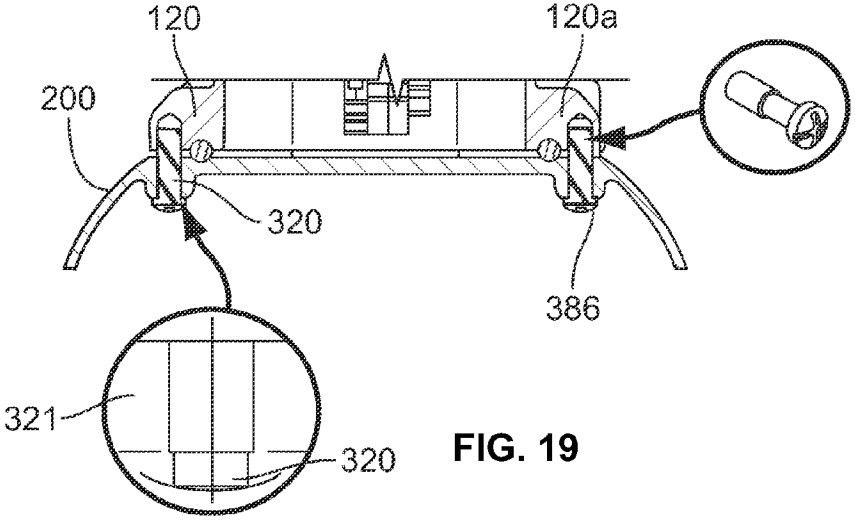
FIG. 19 is a cross sectional side view of reflector 200 secured to bosses 120 and 120*a;*

Mounting screws 214 and 214*a* may be a captive bolt/screw which passes through the vertical slot or cutout (218 or 218*a*) of the mounting brackets 210 and 210*a* to complete the hinge mechanism. As shown in FIG. 19, the final securing together of the lighting housing 100' and reflector member 200 is done by screwing in bolts/screws, including screws 330, 333, 320, and 386, that are preferably captive, through holes in the reflector member 200 and into the bottom of lighting housing 100'. As shown in FIG. 19, captive screw 320 may include a half threaded portion 321, and as shown in FIG. 17 captive screw 214*a'* may include half threaded portion 215.

In order to access the internal components of the lighting housing in the field for installation, maintenance, or service, a technician simply needs to loosen the captive bolts/screws such as screws 320, 333, 320, and 386 securing the reflector member 200 to the bottom of lighting housing 100'. When the bolts/screws are loosened the complete reflector member 200 will gradually move in a downward direction due its own weight. As the reflector moves downward, the vertical slots or cutouts 218 and 218*a* on mounting brackets 210 and 210*a* serve as guides during this movement. As the bolts/screws are completely disengaged from the bottom of lighting housing 100', the reflector member 200 remains hanging from the mounting screws 214 and 214*a* that are used to secure mounting brackets 210 and 210*a* to bosses 120 and 130 of lighting housing 100' The captive bolt/screws 214 and 214*a* provide a rotational axis/hinging point for the reflector member 200 and thereby provide easy access to the internal components within lighting housing 100'.

Once the installation, maintenance, or service is complete, the reflector member 200 is swung back up into engagement with the bottom of lighting housing 100', where mounting screws, including screws 330, 333, 320, and 386 are tightened to secure the reflector member 200 to lighting housing 100', and to begin compressing the gasket member 105 (shown in FIG. 1) which is positioned between reflector member 200 and lighting housing 100'. The freedom of vertical movement of the reflector member 200 during tightening of the screws is guided by the vertical slots or cutouts 218 and 218*a* provided in the mounting brackets 210 and 210*a*. Depending upon the dimensions of vertical slots or cutouts 218 and 218*a*, the intended compression value for the gasket member 105, or the desired/required gap 141 (shown in FIG. 20) may be achieved to provide the desired/required level of ingress protection.

Figure 23:
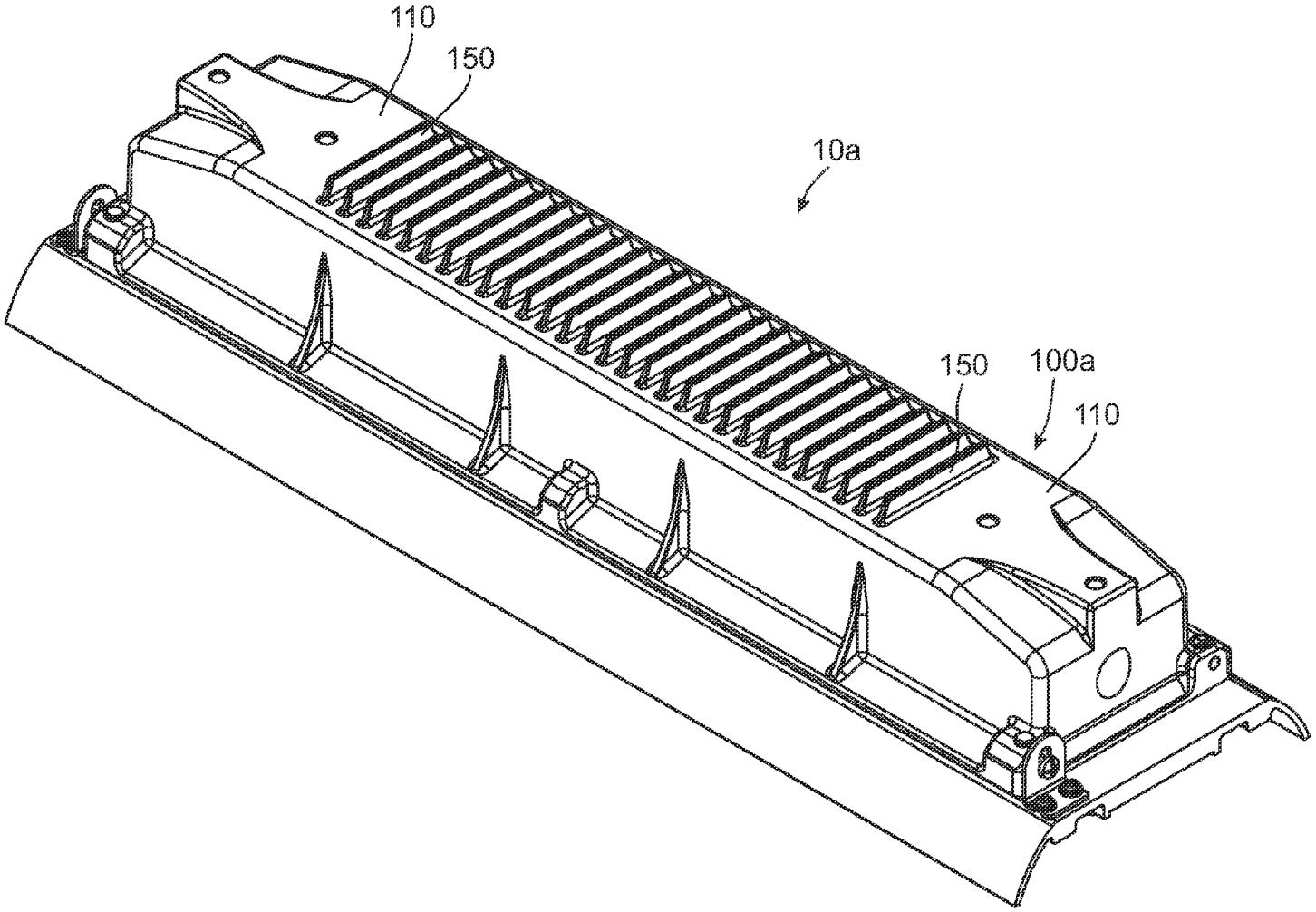
FIG. 23 is a perspective rear side view of the lighting fixture 10*a*, according to an example embodiment.

FIG. 23 shows a perspective view of light fixture 10*a* having lighting housing 100*a*. Lighting housing 100*a* differs from lighting housing 100 shown in FIG. 2 in that it does not includes bosses 160 and 164 and their respective holes 162 and 166 adjacent the far ends of upper fins 150 on the top side 110 of lighting housing 100*a*. Lighting housing 100*a* also does not include the mounting feature shown in the center of fins 150 shown in FIG. 14.

Figure 21:
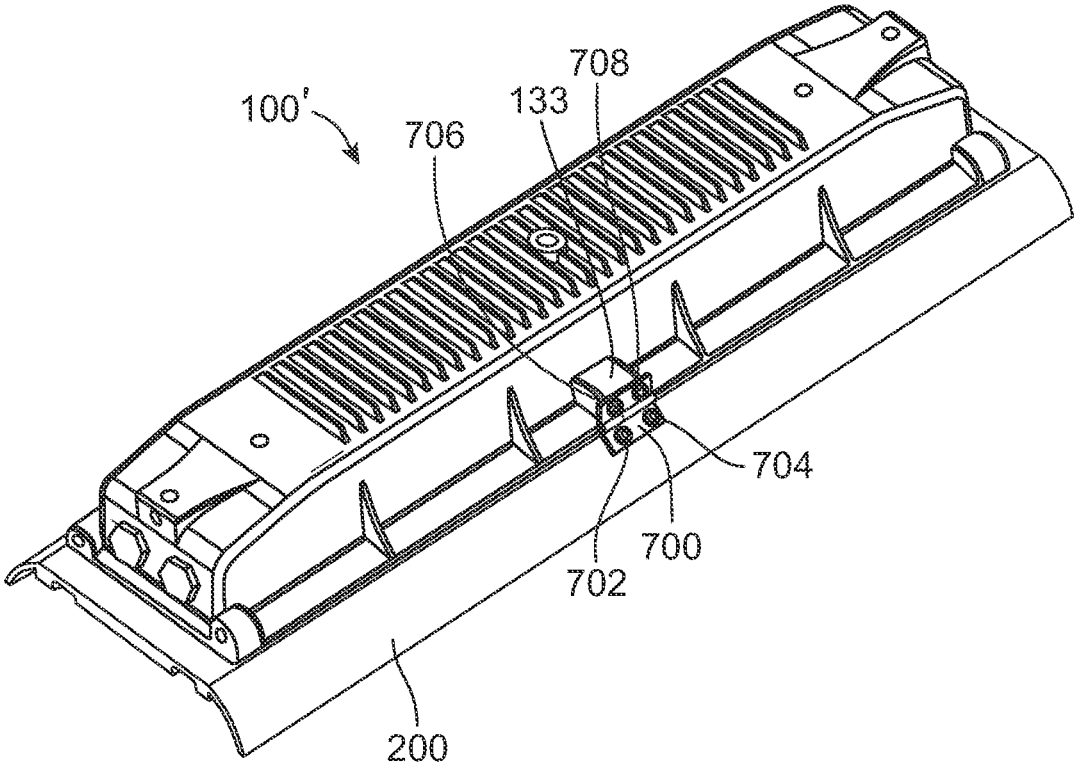
FIG. 21 is a perspective view of LED lighting housing 100' hingedly mounted to reflector member 200 with hinge 700.
Figure 22:
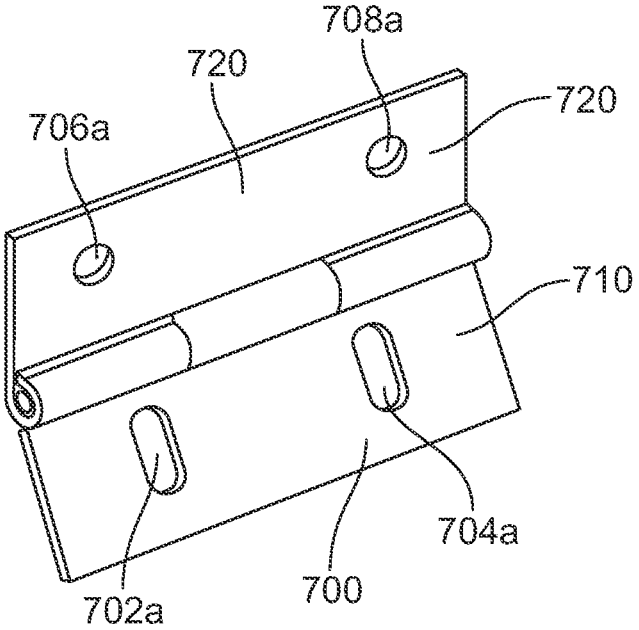
FIG. 22 is a perspective view of hinge 700 shown in FIG. 21.

An alternate hinging mechanism illustrated in FIGS. 21 and 22 may also be used. In particular the hinged mounting between the reflector member 200 and the lighting housing 100' may be achieved with a single hinge 700 which can be mounted or fixed in the center of the lighting device to hingedly attach LED lighting housing 100' with reflector member 200. A metallic or non-metallic hinge similar to the function of a piano hinge can be used for hinge 700. Such a hinge has two flanges 710 and 710 that are pivotable with respect to each other. Hinge 700 may be secured to lighting housing 100' by passing screws 706 and 708 through corresponding vertical slots or cutouts 706*a* and 708*a* in flange 720 and into a boss in the LED lighting housing 100'. Similarly, hinge 700 may be secured to reflector member 200 by passing mounting screws 702 and 704 through vertical slots or cutouts 702*a* and 704*a* in flange 710. Vertical slots or cutouts 702*a* and 704*a* may serve the same purposes as vertical slots or cutouts 718 and 718*a* when using the hinge mechanism illustrated in FIGS. 1-20. Additional hinges, like hinge 700 could also be used, in addition to hinge 700. Furthermore, hinge 700 could also be designed with vertical slots or cutouts 706*a* and 708*a* in flange 720 as vertical slots or cutouts with circular holes in flange 710.

A number of advantages are provided by the present embodiments. In particular, the hinging mechanism provides easy access to the interior of the lighting housing 100' to facilitate the installation, maintenance, and service of the lighting fixture, without requiring the dismantling of the complete fixture from its mounted location. In addition, the compression of the gasket member 105 can be controlled by the geometry of the vertical slots or cutouts on the hinge brackets, such as brackets 210, 210*a*, and 700, and the compression value for different types of gaskets can be controlled. The slotted hinge mechanism also provides the freedom to use different types of gasket members having varying thicknesses, hardnesses, and material.

Furthermore, the slotted hinge mechanism may also be used with metallic and non-metallic junction boxes, a variety of enclosures, distribution equipment, lighting fixtures, plug and receptacles, and wherever there is a need to provide easy access to internal components without dismantling the cover from the body. This slotted hinged mechanism may also be used with products which require self-adjusting or an aligning hinge for assembly of mating parts or halves, for example in hazardous locations where a seal between mating parts is desired.

Example embodiments have been described above. Those skilled in the art will understand that changes and modifications may be made to the described embodiments without departing from the true scope and spirit of the present invention, which is defined by the claims.

We claim:

1. A lighting fixture comprising:

a lighting housing having a top side, a bottom side, a front side, a rear side, a first end and a second end;

a reflector member having a top surface, said reflector member attached to the bottom side of the lighting housing with a plurality of connectors extending through the reflector member;

lights positioned beneath the reflector member;

a first bracket positioned on the top surface the reflector member;

a second bracket positioned on the top surface of the reflector member;

wherein the reflector member is hingedly mounted to the lighting housing using a first fastener extending through a vertical slot of the first bracket on the reflector member, and using a second fastener extending through a vertical slot of the second bracket of the reflector member; wherein the first bracket comprises a lower flange mounted to the top surface of the reflector member and a upwardly extending upper flange having the vertical slot for receiving the first fastener therethrough for mounting to a first end of the lighting housing; and wherein the second bracket comprises a lower flange mounted to the top surface of the reflector member and a upwardly extending upper flange having the vertical slot for receiving the second fastener therethrough for mounting to a second end of the lighting housing;

further including a seal positioned between the lighting housing and the reflector member; and wherein the vertical slots on the upper flanges of the first and second brackets are adapted to adjust to seals of varying thicknesses.

2. The lighting fixture of claim 1, wherein when the plurality of connectors used to attach the reflector member to the lighting housing are removed from the lighting housing, the reflector member is pivotable about the first fastener and the second fastener to allow the reflector member to swing down to allow access to internal components in the bottom side of the lighting housing for servicing or replacing the internal components of the lighting fixture.

3. The lighting fixture of claim 1, wherein the plurality of connectors used to attach the reflector member to the lighting housing are captive screws.

4. The lighting fixture of claim 1, wherein the plurality of connectors used to attach the reflector member to the lighting housing are screws that are threaded into tapped holes positioned on the bottom side of the lighting housing located in respective bosses positioned on the housing.

5. The lighting fixture of claim 1, wherein a first tapped mounting hole is positioned in a first raised boss located on the first end of the lighting housing, and a second tapped mounting hole is positioned in a second raised boss located on the second end of the lighting housing which receive the fasteners extending through the vertical slots of the first and second brackets.

6. The lighting fixture of claim 1, wherein the lights comprise LED lighting.

7. A lighting fixture comprising:

a lighting housing having a top side, a bottom side, a front side, a rear side, a first end and a second end;

a reflector member having a top surface, said reflector member attached to the bottom side of the lighting housing with a plurality of connectors extending through the reflector member;

lights positioned beneath the reflector member;

a first bracket positioned on the top surface the reflector member;

a second bracket positioned on the top surface of the reflector member;

wherein the reflector member is hingedly mounted to the lighting housing using a first fastener extending through a vertical slot of the first bracket on the reflector member, and using a second fastener extending through a vertical slot of the second bracket of the reflector member;

further including a first lighting fixture mounting bracket attached to the top side of the lighting housing and a second lighting fixture mounting bracket attached to the top side of the lighting housing;

wherein the first lighting fixture mounting bracket includes a first flange attached to the first end of the lighting housing, an extending member having a first end attached to the first flange, said extending member upwardly extending from the top side of the lighting housing and having a second end attached to a second flange that outwardly extends past the first end of the housing; wherein one or more mounting holes are positioned on the second flange; and wherein the second lighting fixture mounting bracket includes a first flange attached to the second end of the lighting housing, an extending member having a first end attached to the first flange, said extending member upwardly extending from the top side of the lighting housing and having a second end attached to a second flange that outwardly extends past the second end of the housing; wherein one or more mounting holes are positioned on the second flange.

8. The lighting fixture of claim 7, wherein the first flange and the second flange of the first lighting fixture mounting bracket are positioned in parallel planes, and wherein the first flange and the second flange of the second lighting fixture mounting bracket are positioned in parallel planes.

9. The lighting fixture of claim 7, wherein the second flange of the first lighting fixture mounting bracket and the second flange of the second lighting fixture mounting bracket are coplanar.

10. An LED lighting fixture comprising:

an LED housing having a top side, a bottom side, a front side, a rear side, a first end and a second end;

a reflector member having a top surface, said reflector member attached to the bottom of the LED housing with a plurality of fasteners extending through the reflector member;

LED lights positioned beneath the reflector;

a first lighting fixture mounting bracket attached to the top side of the LED housing; and a second lighting fixture mounting bracket attached to the top side of the LED housing;

further comprising:

a first bracket positioned on the top surface the reflector member;

a second bracket positioned on the top surface of the reflector member;

a first boss positioned on the first end and rear side of the LED housing;

a second boss positioned on the second end and rear side of the LED housing;

wherein the reflector member is hingedly mounted to the LED housing using a first fastener extending through the first bracket on the reflector member and into the first boss on the LED housing, and using a second fastener extending through the second bracket of the reflector member and into the second boss on the LED housing.

11. The LED lighting fixture of claim 10, wherein the first lighting fixture mounting bracket includes a first flange attached to the first end of the LED housing, an extending member having a first end attached to the first flange, said extending member upwardly extending from the top side of the LED housing and having a second end attached to a second flange that outwardly extends past the first end of the housing; wherein one or more mounting holes are positioned on the second flange; and wherein the second lighting fixture mounting bracket includes a first flange attached to the second end of the LED housing, an extending member having a first end attached to the first flange, said extending member upwardly extending from the top side of the LED housing and having a second end attached to a second flange that outwardly extends past the second end of the housing; wherein one or more mounting holes are positioned on the second flange.

12. The LED lighting fixture of claim 11, wherein the first flange and the second flange of the first lighting fixture mounting bracket are positioned in parallel planes, and wherein the first flange and the second flange of the second lighting fixture mounting bracket are positioned in parallel planes.

13. The LED lighting fixture of claim 12, wherein one or more notches are positioned in a transition from the first flange to the extending member in the first lighting fixture mounting bracket and one or more notches are positioned in a transition from the first flange to the extending member in the second lighting fixture mounting bracket.

14. The LED lighting fixture of claim 13, wherein one or more notches are positioned in a transition from the extending member to the second flange in the first lighting fixture mounting bracket and one or more notches are positioned in a transition from the extending member to second flange to the extending member in the second lighting fixture mounting bracket.

15. The LED lighting fixture of claim 11, wherein the second flange of the first lighting fixture mounting bracket and the second flange of the second lighting fixture mounting bracket are coplanar.

16. The LED lighting fixture of claim 10, wherein when a plurality of connectors used to attach the reflector member to the LED housing are removed from the LED housing, the reflector member is pivotable about the first boss and the second boss to allow the reflector member to swing down to allow access to the bottom side of the LED housing for servicing the LED lighting fixture.

17. The LED lighting fixture of claim 10, wherein the plurality of connectors used to attach the reflector member to the LED housing are captive screws.

18. The LED lighting fixture of claim 10, wherein the plurality of connectors used to attach the reflector member to the LED housing are screws that are threaded into tapped holes positioned on the bottom side of the LED housing located in respective bosses positioned on the LED housing.

19. The LED lighting fixture of claim 10, wherein a first tapped mounting hole is positioned in a first raised boss located on the first end of the LED housing, and a second tapped mounting hole is positioned in a second raised boss located on the second end of the LED housing.

20. The LED lighting fixture of claim 10, wherein the first bracket comprises a lower flange mounted to the top surface of the reflector member and a upwardly extending upper flange having a vertical slot for receiving a screw therethrough for mounting to the first boss; and wherein the second bracket comprises a lower flange mounted to the top surface of the reflector member and a upwardly extending upper flange having a vertical slot for receiving a screw therethrough for mounting to the second boss.

21. The LED lighting fixture of claim 16, wherein top surfaces of a plurality of fins on the top side of the LED lighting housing are positioned beneath a plane that the second flange of the first lighting fixture mounting bracket and the second flange of the second lighting fixture mounting bracket are positioned in.

22. The LED lighting fixture of claim 21, wherein a mounting hole on the second flange of the first lighting fixture mounting bracket and a mounting hole on the second flange of the second lighting fixture mounting bracket are positioned 27.6 inches apart to provide a retrofit option for an existing tubular fluorescent fixture having a reflector length of four feet.

23. A lighting fixture comprising:

a lighting housing having a top side, a bottom side, a front side, a rear side, a first end and a second end;

a reflector member having a top surface, said reflector member attached to the bottom side of the lighting housing with a plurality of connectors extending through the reflector member;

lights positioned beneath the reflector member;

a first bracket positioned on the top surface the reflector member;

a second bracket positioned on the top surface of the reflector member;

wherein the reflector member is hingedly mounted to the lighting housing using a first fastener extending through a vertical slot of the first bracket on the reflector member, and using a second fastener extending through a vertical slot of the second bracket of the reflector member, wherein the first fastener extends through the vertical slot in the first bracket on the reflector member and into a first boss on the lighting housing, and the second fastener extends through the vertical slot in the second bracket of the reflector member and into a second boss on the lighting housing.

24. The LED lighting fixture of claim 23, further including a seal positioned between the lighting housing and the reflector member, wherein the vertical slots on the upper flanges of the first and second brackets are adapted to adjust to seals of varying thicknesses.

25. A lighting fixture comprising:

a lighting housing having a top side, a bottom side, a front side, a rear side, a first end and a second end;

a reflector member having a top surface, said reflector member attached to the bottom side of the lighting housing with a plurality of fasteners extending through the reflector member;

lights positioned beneath the reflector member;

a hinge having a first flange secured to the rear side of the lighting housing and a second flange secured to the top surface of the reflector member;

wherein one of the first and second flanges is secured by using one or more mounting screws extending through one or more vertical slots in the one of the first and second flanges;

further including a seal positioned between the lighting housing and the reflector member, wherein the vertical slots are adapted to adjust to seals of varying thickness and provide the required sealing.

* * * * *